US011117387B2

(12) United States Patent
Zhang

(10) Patent No.: US 11,117,387 B2
(45) Date of Patent: Sep. 14, 2021

(54) LIQUID EJECTION DEVICE

(71) Applicant: SEIKO EPSON CORPORATION, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/787,734

(22) Filed: Feb. 11, 2020

(65) Prior Publication Data

US 2020/0254777 A1 Aug. 13, 2020

(30) Foreign Application Priority Data

Feb. 12, 2019 (JP) ..... JP2019-022349

(51) Int. Cl.
*B41J 2/175* (2006.01)
*B41J 2/18* (2006.01)

(52) U.S. Cl.
CPC ..... *B41J 2/17596* (2013.01)

(58) Field of Classification Search
CPC ..... B41J 2/17596; B41J 2/18
See application file for complete search history.

(56) References Cited

U.S. PATENT DOCUMENTS

2008/0158320 A1 7/2008 Nitta et al.
2017/0320331 A1* 11/2017 Alessi ..... B41J 2/175

FOREIGN PATENT DOCUMENTS

JP 2008-162284 7/2008

* cited by examiner

*Primary Examiner* — Jason S Uhlenhake
(74) *Attorney, Agent, or Firm* — Workman Nydegger

(57) ABSTRACT

A circulation head includes an upstream port and a downstream port that are in communication with a pressure chamber, and includes three ink tanks (first to third tanks). Each of the ink tanks (the first to third tanks) includes an ink inlet/outlet port that is in communication with the upstream port and the downstream port, and an opening/closing valve that independently opens and closes the ink inlet/outlet port of each of the ink tanks (the first to third tanks) with respect to the upstream port and the downstream port.

7 Claims, 25 Drawing Sheets

LIQUID EJECTION DEVICE

The present application is based on, and claims priority from JP Application Serial Number 2019-022349, filed Feb. 12, 2019, the disclosure of which is hereby incorporated by reference herein in its entirety.

BACKGROUND

1. Technical Field

The present disclosure relates to a liquid ejection device, and particularly relates to a liquid ejection device that causes liquid, such as ink, to flow through a circulation head.

2. Related Art

Some inkjet recording devices cause ink to flow through a pressure chamber of a head in order to prevent the ink from remaining in the pressure chamber of the head. An inkjet recording device disclosed in JP-A-2008-162284 includes an upstream port and a downstream port that are in communication with a pressure chamber of a circulation head, and causes ink to pass through the pressure chamber of the circulation head via the upstream port and the downstream port. Thus, the inkjet recording device is provided with a main tank, an ink tank serving as a supply source, and a meniscus pressure tank, and ink is caused to flow, via the circulation head, from the ink tank serving as the supply source to the main tank via the meniscus pressure tank.

In the above-described inkjet recording device of the related art, the ink is caused to flow using a difference in water head pressures between the ink tank serving as the supply source and the meniscus pressure tank, and roles of the ink tank serving as the supply source, the meniscus pressure tank, and the main tank are fixed. In addition, ink replenishing needs to be performed only in the main tank.

Further, although the flow of the ink is determined by the difference in the water head pressures between the ink tank serving as the supply source and the meniscus pressure tank, since the water head values change in accordance with changes in the amount of ink, it is difficult to keep the flow of the ink constant. Furthermore, since the flow of the ink and the pressure in the tank also change at the time of the ink replenishment, it is difficult to keep the flow of the ink constant. On the other hand, when printing is stopped in the middle of the printing to adjust the water head values or to perform the ink replenishment, there is a problem that drying becomes uneven in a printed material, in a discontinuous manner.

SUMMARY

The present disclosure provides a liquid ejection device in which ink replenishment is conveniently performed and which suppresses changes in a flow of ink.

The present disclosure is a liquid ejection device that includes a circulation head including an upstream port and a downstream port that are in communication with a pressure chamber and a plurality of ink tanks and that causes ink to pass through the circulation head via the upstream port and the downstream port and flow from one of the ink tanks to another one of the ink tanks. The liquid ejection device includes at least three of the ink tanks. Each of the ink tanks includes an ink inlet/outlet port in communication with the upstream port and the downstream port and an opening/closing valve that independently opens and closes the ink inlet/outlet port of each of the ink tanks with respect to the upstream port and the downstream port.

Further, the present disclosure may be configured to further include a pressure regulation control unit configured to regulate, for each of the ink tanks, a pressure in each of the ink tanks, and an opening/closing valve control unit configured to control, for each of the ink tanks, opening and closing of each of the opening/closing valves.

Furthermore, the pressure regulation control unit may control the pressure in each of the ink tanks so as to cause one of the ink tanks to be an ink tank serving as a supply source and another one of the ink tanks to be an ink tank serving as a supply destination, and the opening/closing valve control unit may control the opening and closing of each of the opening/closing valves so as to cause the ink to be supplied from the ink tank serving as the supply source to the circulation head and the ink to be supplied from the circulation head to the ink tank serving as the supply destination.

According to an aspect of the present disclosure, any one of the plurality of ink tanks can be used for ink replenishing, and the flow of the ink can be made constant.

BRIEF DESCRIPTION OF THE DRAWINGS

FIG. 24A is a diagram illustrating an entire ink supply path, and FIG. 24B is a diagram illustrating the ink supply path near a circulation head.

DESCRIPTION OF EXEMPLARY EMBODIMENTS

Exemplary embodiments of the present disclosure will be described below with reference to the accompanying drawings.

Figure 1:
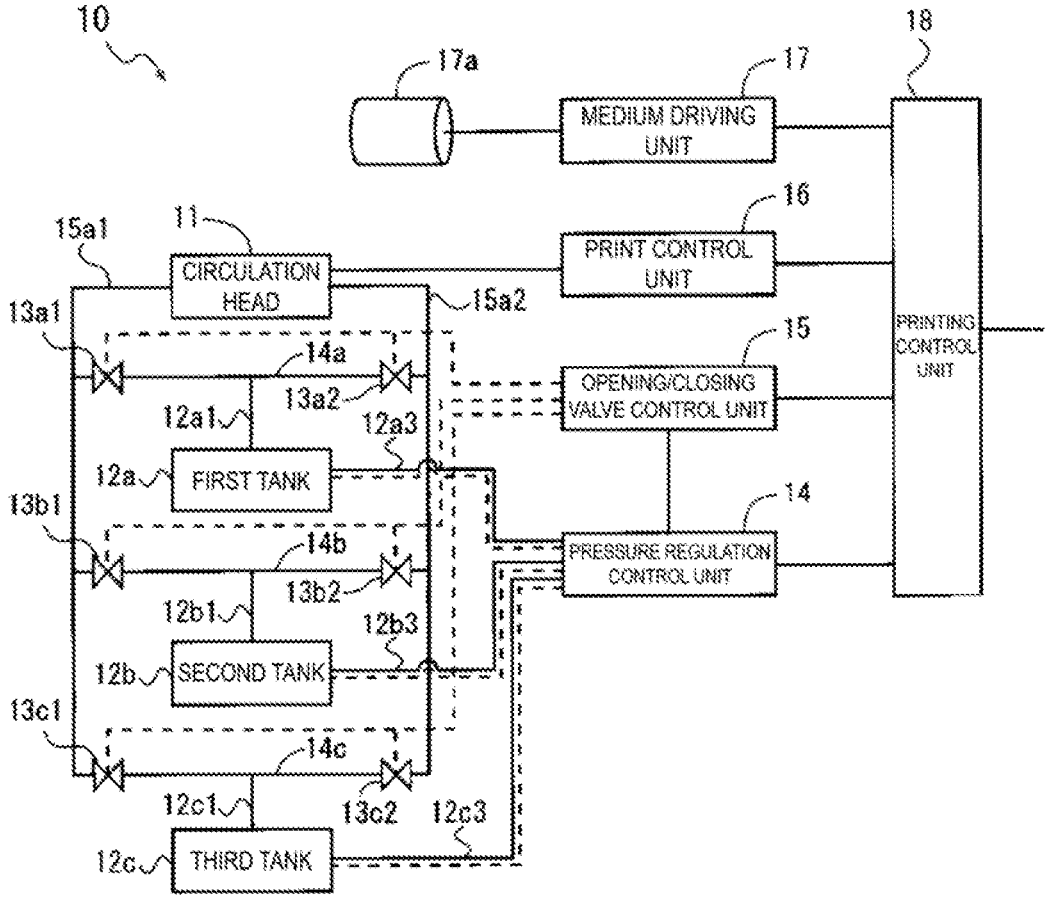
FIG. 1 is a schematic configuration diagram of an inkjet recording device according to an example of the present disclosure.
Figure 2:
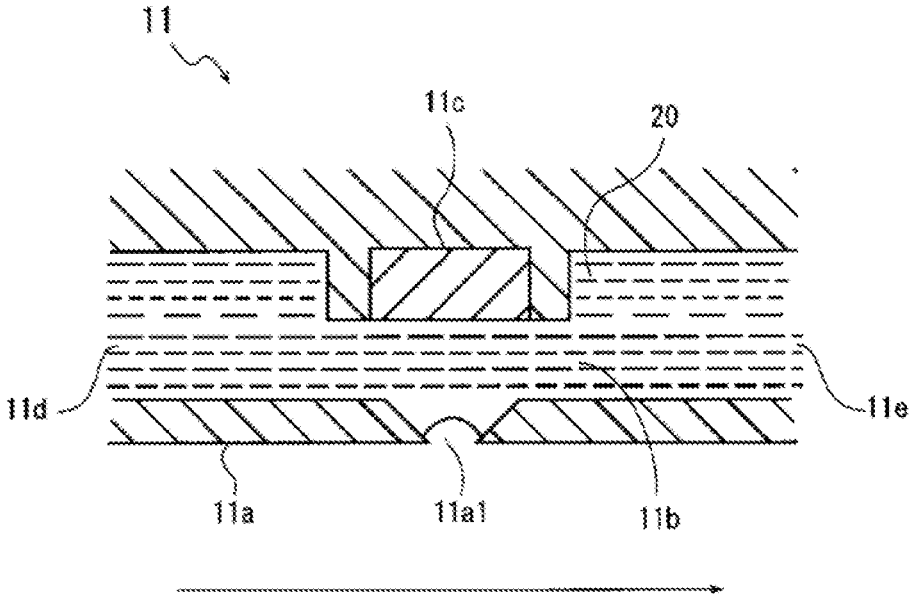
FIG. 2 is a cross-sectional view of main portions of a printing head of the inkjet recording device.
Figure 3:
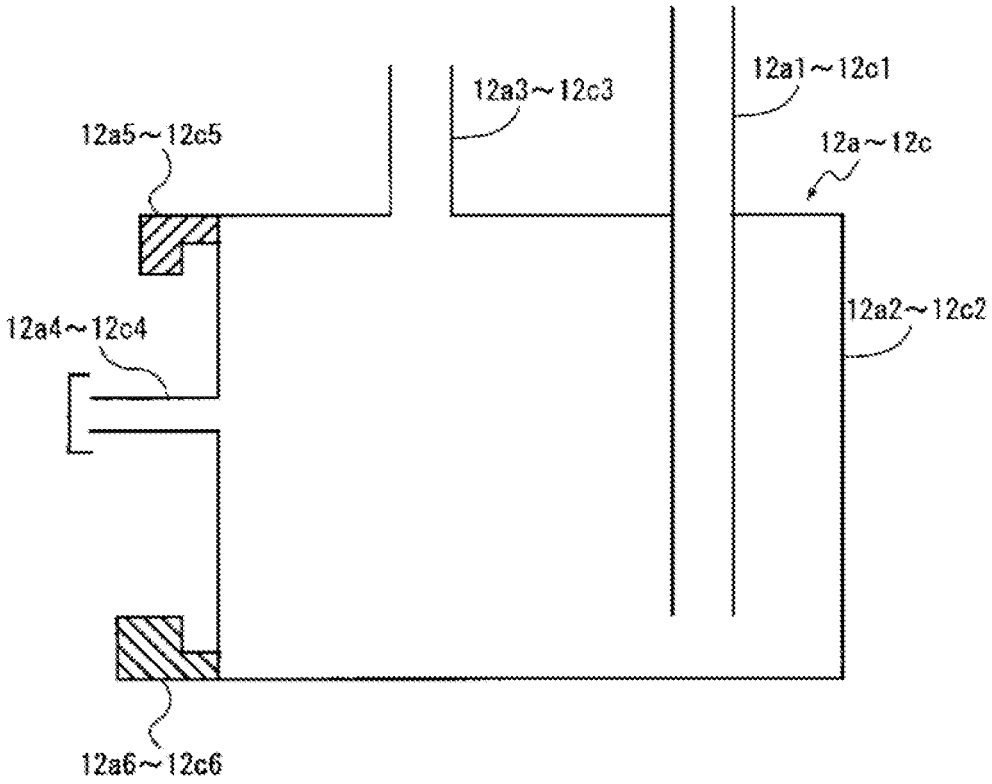
FIG. 3 is a schematic cross-sectional view of an ink tank of the inkjet recording device.

FIG. 1 is a schematic diagram illustrating an inkjet recording device according to an embodiment of a liquid ejection device, which is the present disclosure, FIG. 2 is a cross-sectional view of main portions of a printing head of the inkjet recording device, and FIG. 3 is a schematic cross-sectional view of an ink tank of the inkjet recording device.

In FIG. 1, an inkjet recording device 10 includes a circulation head 11, and the circulation head 11 is an inkjet head configured to eject ink. In FIG. 2, the circulation head 11 is provided with an orifice plate 11*a* that includes a nozzle 11*a*1. A pressure chamber 11*b* is formed on a back surface side of the orifice plate 11*a*. Ink circulates through this pressure chamber 11*b*. An actuator 11*c* is provided on an opposite surface of the pressure chamber 11*b* from the nozzle 11*a*1. As a result of the actuator 11*c* being driven, the volume of the pressure chamber 11*b* changes, and ink droplets are ejected from the nozzle 11*a*1. As the actuator 11*c*, for example, a device that directly or indirectly deforms the pressure chamber using a piezoelectric element such as a piezo element (PZT), a device that drives a diaphragm using static electricity, a device that directly moves the ink using static electricity, and the like can be employed, but the actuator 11*c* is not limited to these examples. Each of the circulation heads 11 includes an upstream port 11*d* and a downstream port lie at positions on either side of the pressure chamber 11*b*. The upstream port 11*d* and the downstream port lie of each of the circulation heads 11 are coupled to ink inlet/outlet ports 12*a*1 to 12*c*1 of first to third tanks (tanks) 12*a* to 12*c* via opening/closing valves 13*a*1, 13*a*2, 13*b*1, 13*b*2, 13*c*1, and 13*c*2. In the circulation head 11 configured in this manner, ink 20 passes through the pressure chamber 11*b* and circulates from left to right, for example, as indicated by an arrow in FIG. 2.

In this way, the three first to third tanks 12*a* to 12*c* are provided as the ink tanks.

In FIG. 3, the ink inlet/outlet ports 12*a*1 to 12*c*1 of the first to third tanks 12*a* to 12*c* are inserted from upper surfaces of tank main bodies 12*a*2 to 12*c*2 and are open near bottom surfaces thereof. Pressure regulating pipes 12*a*3 to 12*c*3 are coupled to the upper surfaces of the tank main bodies 12*a*2 to 12*c*2 and are open on substantially ceiling surfaces thereof. Ink replenishing ports 12*a*4 to 12*c*4 are formed on side surfaces of the tank main bodies 12*a*2 to 12*c*2, and the ink can be replenished by opening and closing the ink replenishing ports 12*a*4 to 12*c*4. Air pressure sensors 12*a*5 to 12*c*5 are disposed on upper parts of the side surfaces of the tank main bodies 12*a*2 to 12*c*2, and water pressure sensors 12*a*6 to 12*c*6 are disposed on lower parts of the tank main bodies 12*a*2 to 12*c*2. The air pressure sensors 12*a*5 to 12*c*5 detect water head pressures of the ink via air pressures in the tank main bodies 12*a*2 to 12*c*2, and the water pressure sensors 12*a*6 to 12*c*6 detect the amount of ink via water pressures.

The opening/closing valves 13*a*1 and 13*a*2 are coupled to the ink inlet/outlet port 12*a*1 via a pipe conduit 14*a*, the opening/closing valves 13*b*1 and 13*b*2 are coupled to the ink inlet/outlet port 12*b*1 via a pipe conduit 14*b*, and the opening/closing valves 13*c*1 and 13*c*2 are coupled to the ink inlet/outlet port 12*c*1 via a pipe conduit 14*c*. Further, the opening/closing valves 13*a*1, 13*b*1, and 13*c*1 are coupled to the upstream port 11*d* of the circulation head 11 via a pipe conduit 15*a*1, and the opening/closing valves 13*a*2, 13*b*2, and 13*c*2 are coupled to the downstream port lie of the circulation head 11 via a pipe conduit 15*a*2.

In this way, the circulation head 11 includes the upstream port 11*d* and the downstream port lie that are in communication with the pressure chamber 11*b*, and includes the three ink tanks (the first to third tanks 12*a* to 12*c*). The ink tanks (the first to third tanks 12*a* to 12*c*) respectively include the ink inlet/outlet ports 12*a*1 to 12*c*1 that are in communication with the upstream port 11*d* and the downstream port 11*e*, and respectively include the opening/closing valves 13*a*1, 13*a*2, 13*b*1, 13*b*2, 13*c*1, and 13*c*2, each of which independently opens and closes the ink inlet/outlet port 12*a*1 to 12*c*1 of each of the ink tanks (the first to third tanks 12*a* to 12*c*) with respect to the upstream port 11*d* and the downstream port 11*e*.

The pressure regulating pipe 12*a*3 to 12*c*3, the air pressure sensors 12*a*5 to 12*c*5, and the water pressure sensor 12*a*6 to 12*c*6 are coupled to a pressure regulation control unit 14. As will be described below, the pressure regulation control unit 14 causes the ink to flow from one of the first to third tanks 12*a* to 12*c* to another one of the first to third tanks 12*a* to 12*c*, via the circulation head 11. At this time, the pressure regulation control unit 14 refers to detection results of the air pressure sensors 12*a*5 to 12*c*5 and the water pressure sensors 12*a*6 to 12*c*6, and controls the air pressures in the first to third tanks 12 *a* to 12*c* via the pressure regulating pipes 12*a*3 to 12*c*3.

The ink flows from one of the first to third tank 12*a* to 12*c*, which serves as a supply source, to another one of the first to third tank 12*a* to 12*c*, which serves as a supply destination. By controlling the opening and closing of the opening/closing valves 13*a*1, 13*a*2, 13*b*1, 13*b*2, 13*c*1, and 13*c*2, an opening/closing valve control unit 15 can determine which of the tanks is to be used as the supply source and which of the tanks is to be used as the supply destination. The opening/closing valve control unit 15 controls the opening and closing of the opening/closing valves 13*a*1, 13*a*2, 13*b*1, 13*b*2, 13*c*1, and 13*c*2 in synchronization with the pressure regulation control unit 14.

The inkjet recording device 10 includes one or a plurality of the circulation heads 11 arranged in rows (such as a single row or a staggered arrangement) along the width direction of a recording medium, and prints a predetermined character or image by driving the actuator 11*c* of the circulation head 11 while feeding the recording medium in the lengthwise direction and by ejecting the ink in the pressure chamber 11*b* onto the recording medium from the nozzle 11*a*1. A print control unit 16 controls driving of each of the actuators 11*c* in the circulation heads 11, and a medium driving unit 17 drives a drive motor 17*a* to transport the recording medium. A printing control unit 18 controls printing and circulation of the ink by controlling the pressure regulation control unit 14, the opening/closing valve control unit 15, the print control unit 16, and the medium driving unit 17.

FIGS. 4 to 15 illustrate states in which the opening/closing valve control unit 15 controls the opening and closing of the opening/closing valves 13*a*1, 13*a*2, 13*b*1, 13*b*2, 13*c*1, and 13*c*2 to determine which of the tanks is to be used as the supply source and which of the tanks is to be used as the supply destination. The opening/closing valves 13*a*1, 13*a*2, 13*b*1, 13*b*2, 13*c*1, and 13*c*2 are opened and closed so that the ink inlet/outlet port of the tank to be used as the supply source is in communication with the upstream port 11*d* of the circulation head 11, and the ink inlet/outlet port of the tank to be used as the supply destination is in communication with the downstream port lie of the circulation head 11.

Figure 4:
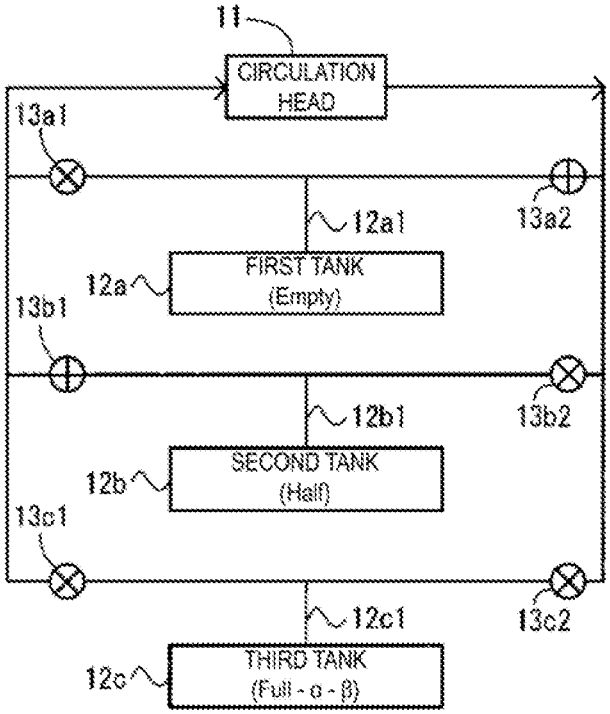
FIG. 4 is a schematic configuration diagram illustrating a state of a process of circulating ink using three of the ink tanks.

FIG. 4 illustrates open/closed states of the opening/closing valves when the first tank 12*a* is the supply destination, the second tank 12*b* is the supply source, and the third tank 12*c* is a replenishing tank. Note that in FIG. 4, the liquid level in the first tank 12*a* is at a predetermined value close to being substantially empty (Empty: hereinafter referred to as empty), the liquid level in the second tank 12*b* is at a predetermined value slightly greater than half (Half: hereinafter referred to as half), and the liquid level in the third tank 12*c* is slightly less than full (Full−α−β). The opening/closing valves 13*a*2 and 13*b*1 are opened, and the other opening/closing valves 13*a*1, 13*b*2, 13*c*1, and 13*c*2 are closed. The third tank 12*c* is not in communication with the upstream port 11*d* and the downstream port lie, and in this state, the ink replenishing port (12*c*4) of the third tank 12*c* is opened and the ink is replenished from the main tank (not illustrated) until the liquid level of the third tank 12*c* reaches a predetermined value at which the liquid surface is substantially full (Full: hereinafter referred to as full).

After the ink has been replenished in the third tank 12*c*, and once the amount of ink in the second tank 12*b* serving as the supply source is reduced to half, the supply source is changed to the third tank 12*c*.

Figure 5:
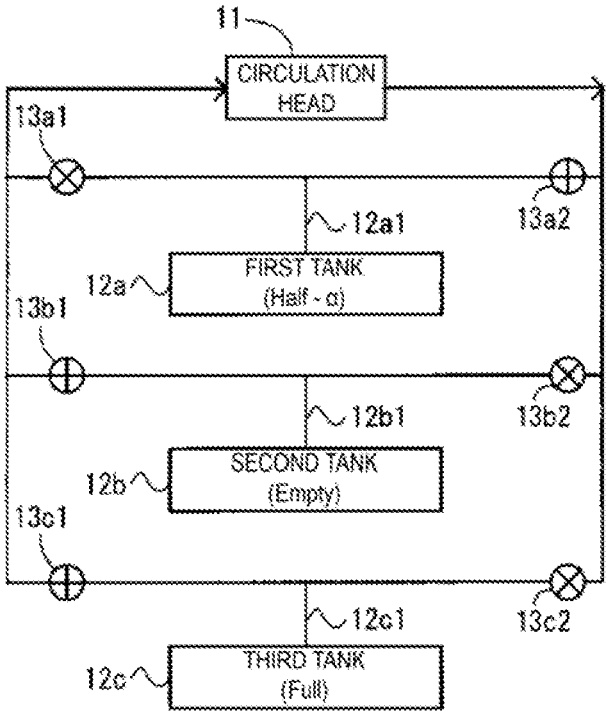
FIG. 5 is a schematic configuration diagram illustrating a state of the process of circulating the ink using the three ink tanks.

FIG. 5 illustrates a state in which the supply source is changed to the third tank 12*c*. The opening/closing valve 13*c*1 is additionally opened to temporarily cause both the second tank 12*b* and the third tank 12*c* to be the supply source. This state corresponds to "when the opening/closing valve is opened", and this means that "when the opening/closing valve of one of the ink tanks is opened, the opening/closing valve goes through a state of being open simultaneously to the plurality of ink tanks".

That is, when a circulation path is switched from the first ink tank to the second ink tank, a state is generated in which the opening/closing valve is simultaneously open to both of the ink tanks.

When one of the opening/closing valves is additionally opened, the opening/closing valve is opened slowly in order not to disturb a state in which the ink is flowing to the circulation head 11 via the already opened opening/closing valves. Specifically, when each of the opening/closing valves is opened and closed, the opening/closing valve control unit 15 causes a time required to open the opening/closing valve to be longer than a time required to close the opening/closing valve.

After that, when a predetermined period of time has elapsed, the opening/closing valve control unit 15 closes the opening/closing valve 13*b*1 and causes only the third tank 12*c* to be the supply source. Note that at this point of time, the liquid level of the first tank 12*a* is less than half (Half−α). Since the ink is reduced as a result of being ejected from the circulation head 11 while the ink is being transferred from the second tank 12*b* to the first tank 12*a*, a state is obtained in which the liquid level is less than half by an amount α, which is an amount of ink ejected from the circulation head 11. Hereinafter, the amount of ink ejected from the circulation head 11 while the ink is being transferred from the ink tank serving as the supply source to the ink tank serving as the supply destination will be referred to as α or β. Note that a and R are not constant values since the values change depending on the amount of ink ejected from the circulation head 11. After the opening/closing valve 13*c*1 is opened, the opening/closing valve 13*c*1 is closed after the predetermined period of time has elapsed. Thus, the liquid level of the second tank 12*b* is reduced to be less than empty as a result of the ink being transferred to the first tank 12*a* during the predetermined period of time, but since the reduced amount is negligibly small, a description thereof is omitted here.

Figure 6:
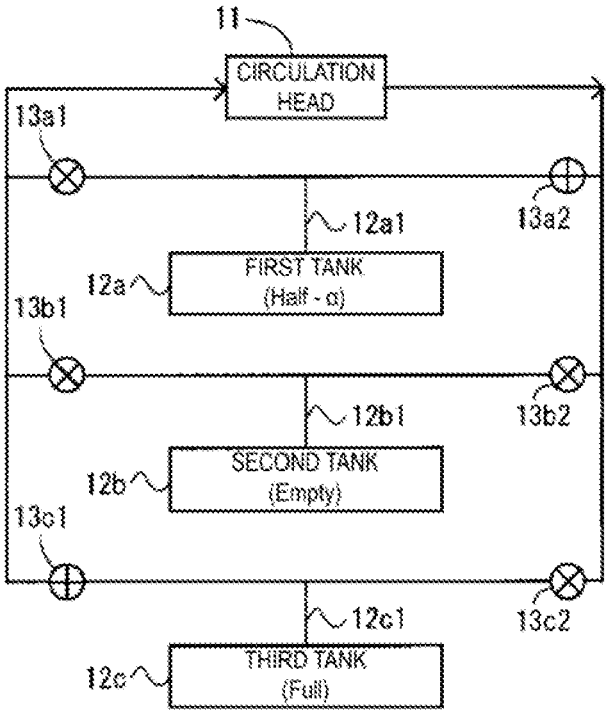
FIG. 6 is a schematic configuration diagram illustrating a state of the process of circulating the ink using the three ink tanks.

FIG. 6 illustrates the open/closed states of the opening/closing valves when the first tank 12*a* is the supply destination, the second tank 12*b* is the replenishing tank, and the third tank 12*c* is the supply source. The opening/closing valves 13*a*2 and 13*c*1 are opened, and the other opening/closing valves 13*a*1, 13*b*1, 13*b*2, and 13*c*2 are closed. When comparing this state with the state illustrated in FIG. 5, the opening/closing valve 13*b*1 that has caused the ink inlet/outlet port 12*b*1 of the second tank 12*b* to be in communication with the upstream port 11*d* is closed.

As a result of the ink flowing, the liquid level of the third tank 12*c* serving as the supply source starts to fall below full, and the transfer of the ink is continued until the liquid level reaches half. When the liquid level of the third tank 12*c* has reached half, the liquid level of the first tank 12*a* becomes less than full (Full−α−β). This is because the ink is reduced as a result of being ejected from the circulation head 11 while the ink is being transferred from the third tank 12*c* to the first tank 12*a*. As a result, a state is obtained in which the liquid level is even less than the state of being less than full (Full−α), by an amount R that is the amount of ink ejected from the circulation head 11 (Full−α−β).

Once the liquid level of the ink tank serving as the supply source falls to half, the ink tank whose liquid level is empty is changed to be the ink tank serving as the supply destination. When changing the ink tank serving as the supply destination, the new ink tank serving as the supply destination is temporarily added as the ink tank serving as the supply destination, and after the addition, the previous ink tank serving as the supply destination is closed.

Figure 7:
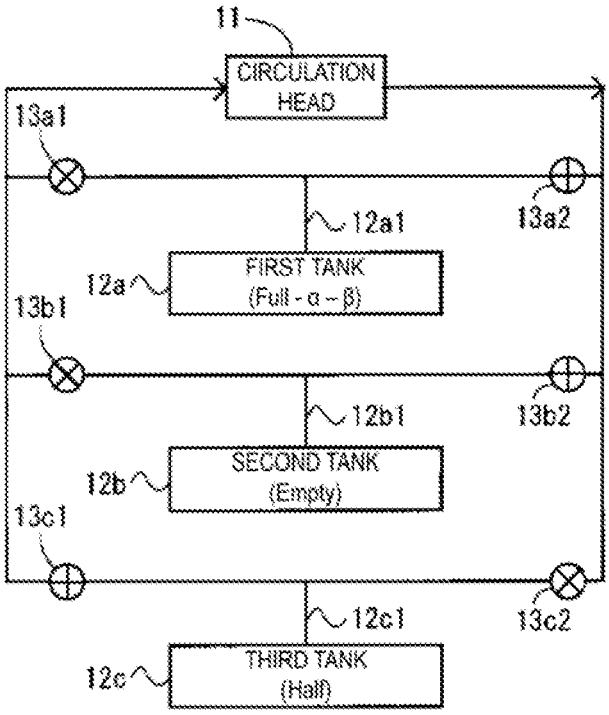
FIG. 7 is a schematic configuration diagram illustrating a state of the process of circulating the ink using the three ink tanks.
Figure 8:
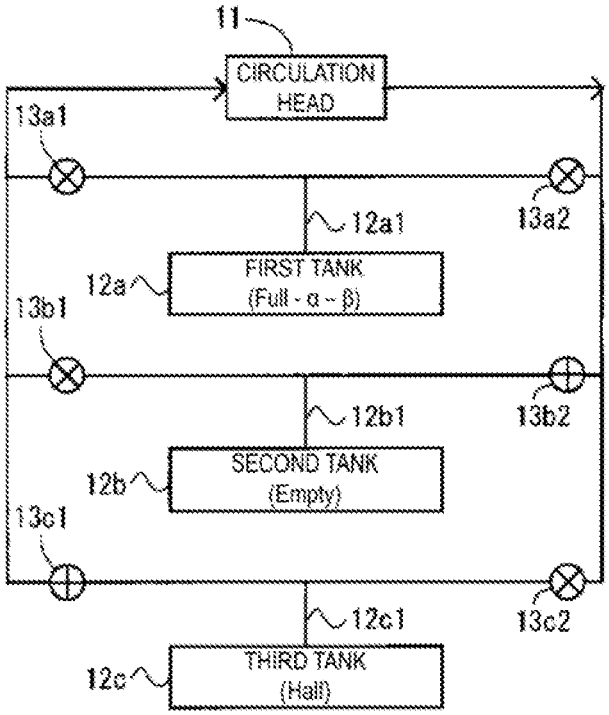
FIG. 8 is a schematic configuration diagram illustrating a state of the process of circulating the ink using the three ink tanks.

FIG. 7 is a state in which the second tank 12*b* is added as the supply destination, and FIG. 8 is a state in which the first tank 12*a*, which is the previous supply destination, is closed.

FIG. 7 illustrates the open/closed states of the opening/closing valves when the first tank 12*a* and the second tank 12*b* are the supply destinations, and the third tank 12*c* is the supply source. The opening/closing valves 13*a*2, 13*b*2, and 13*c*1 are opened, and the other opening/closing valves 13*a*1, 13*b*1, and 13*c*2 are closed. The ink inlet/outlet ports 12*a*1 and 12*c*1 are temporarily open to two of the ink tanks, namely, the first tank 12*a* and the second tank 12*b*.

FIG. 8 illustrates the open/closed states of the opening/closing valves when the first tank 12*a* is the replenishing tank, the second tank 12*b* is the supply destination, and the third tank 12*c* is the supply source. The opening/closing valves 13*b*2 and 13*c*1 are opened, and the other opening/closing valves 13*a*1, 13*a*2, 13*b*1, and 13*c*2 are closed. The first tank 12*a* is not in communication with the upstream port 11*d* and the downstream port lie, and in this state, the ink replenishing port 12*a*4 of the first tank 12*a* is opened and the ink is replenished from the main tank (not illustrated) until the liquid level of the first tank 12*a* reaches full.

FIG. 4 is a state in which the third tank 12*c* is the replenishing tank, and the state has transitioned, through the states illustrated in FIG. 5 to FIG. 7, to the state illustrated in FIG. 8 in which the first tank 12*a* is the replenishing tank.

Figure 9:
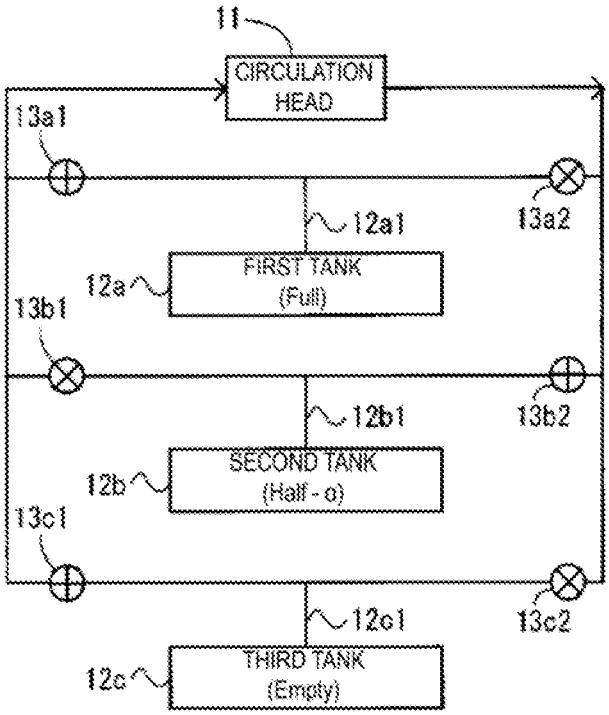
FIG. 9 is a schematic configuration diagram illustrating a state of the process of circulating the ink using the three ink tanks.
Figure 10:
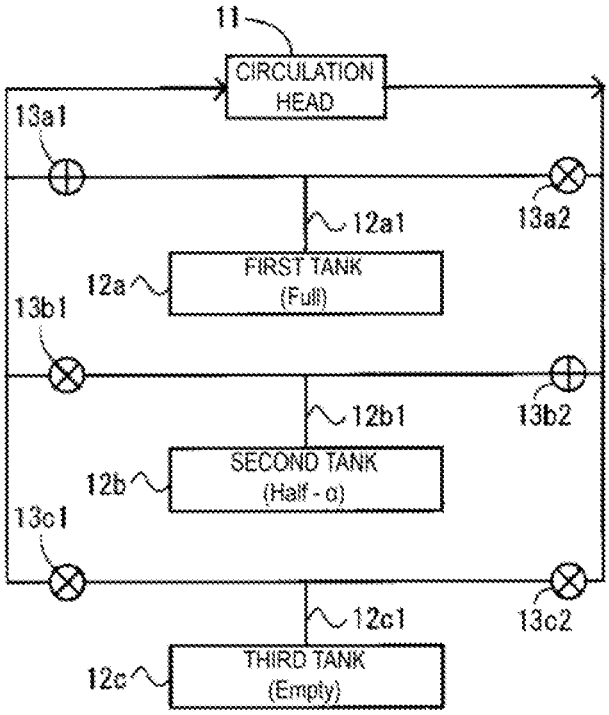
FIG. 10 is a schematic configuration diagram illustrating a state of the process of circulating the ink using the three ink tanks.
Figure 11:
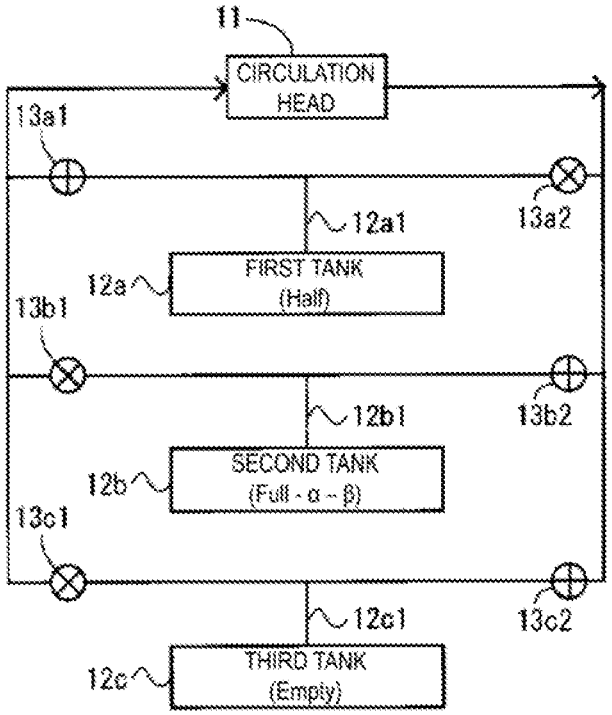
FIG. 11 is a schematic configuration diagram illustrating a state of the process of circulating the ink using the three ink tanks.
Figure 12:
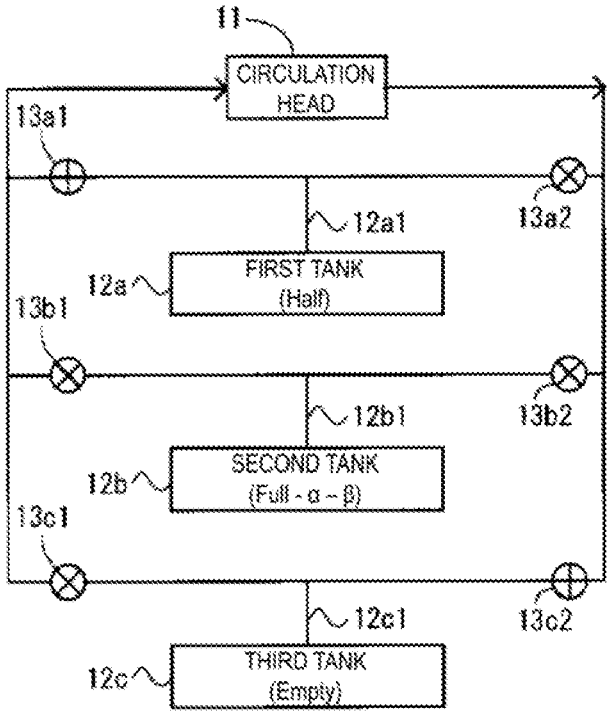
FIG. 12 is a schematic configuration diagram illustrating a state of the process of circulating the ink using the three ink tanks.

After that, through states illustrated in FIG. 9 to FIG. 11, the state transitions to a state illustrated in FIG. 12 in which the second tank 12*b* is the replenishing tank.

FIG. 9 illustrates a state in which the first tank 12*a* is added as the supply source, FIG. 10 illustrates a state in which the third tank 12*c*, which is previously the supply source, is isolated, FIG. 11 illustrates a state in which the third tank 12*c* is added as the supply destination, and FIG. 12 illustrates a state in which the second tank 12*b*, which is previously the supply destination, is isolated so as to cause it to be the replenishing tank.

FIG. 9 illustrates the open/closed states of the opening/closing valves when the first tank 12*a* and the third tank 12*c* are the supply sources and the second tank 12*b* is the supply destination. The opening/closing valves 13*a*1, 13*b*2, and 13*c*1 are opened, and the other opening/closing valves 13*a*2, 13*b*1, and 13*c*2 are closed.

FIG. 10 illustrates the open/closed states of the opening/closing valves when the first tank 12*a* is the supply source, and the second tank 12*b* is the supply destination. The opening/closing valves 13*a*1 and 13*b*2 are opened, and the other opening/closing valves 13*a*2, 13*b*1, 13*c*1, and 13*c*2 are closed.

FIG. 11 illustrates the open/closed states of the opening/closing valves when the first tank 12*a* is the supply source, the second tank 12*b* and the third tank 12*c* are the supply destinations. The opening/closing valves 13*a*1, 13*b*2, and 13*c*2 are opened, and the other opening/closing valves 13*a*2, 13*b*1, and 13*c*1 are closed. In this way, FIG. 8 is the state in which the first tank 12*a* is the replenishing tank, and the state has transitioned, through the states illustrated in FIG. 9 to FIG. 12, to a state illustrated in FIG. 13 in which the second tank 12*b* is the replenishing tank.

Figure 13:
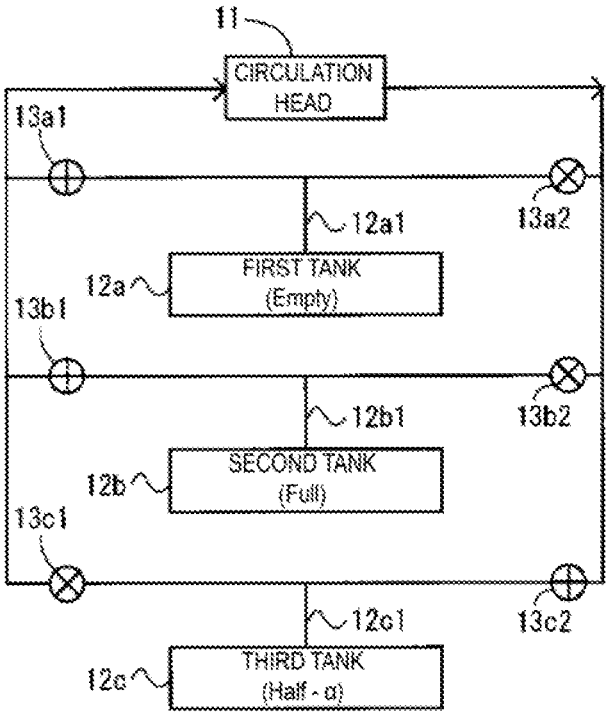
FIG. 13 is a schematic configuration diagram illustrating a state of the process of circulating the ink using the three ink tanks.
Figure 14:
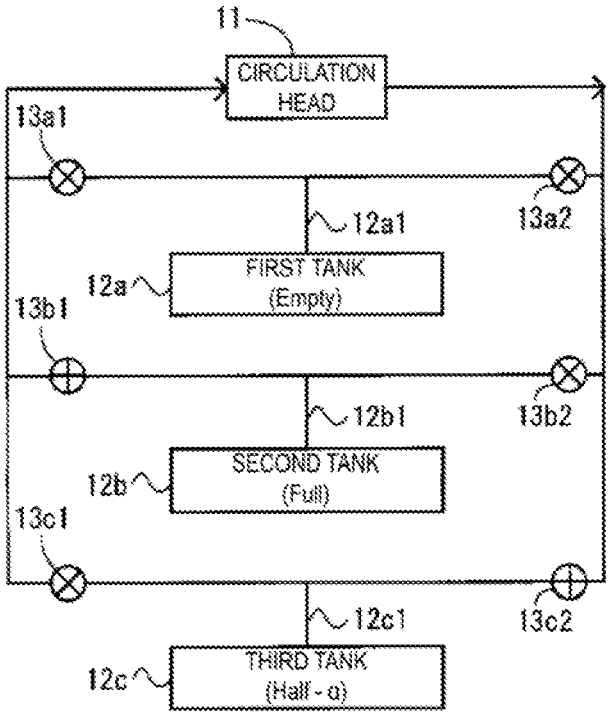
FIG. 14 is a schematic configuration diagram illustrating a state of the process of circulating the ink using the three ink tanks.
Figure 15:
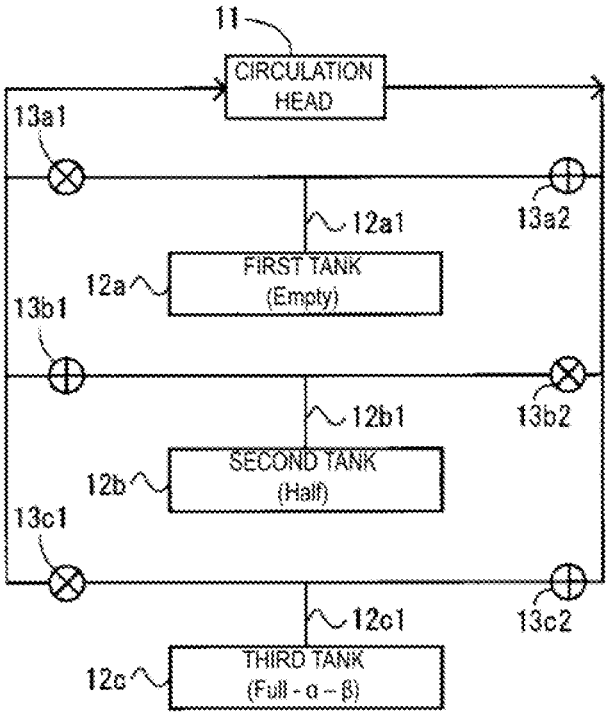
FIG. 15 is a schematic configuration diagram illustrating a state of the process of circulating the ink using the three ink tanks.

Further, through states illustrated in FIG. 13 to FIG. 15, the state transitions to the initial state illustrated in FIG. 4 in which the third tank 12*c* is the replenishing tank.

FIG. 13 illustrates a state in which the second tank 12*b* is added as the supply source, FIG. 14 illustrates a state in which the first tank 12*a*, which is previously the supply source, is isolated, FIG. 15 illustrates a state in which the first tank 12*a* is added as the supply destination, and FIG. 4 illustrates a state in which the third tank 12*c*, which is previously the supply destination, is isolated so as to cause it to be the replenishing tank.

FIG. 13 illustrates the open/closed states of the opening/closing valves when the first tank 12*a* and the second tank 12*b* are the supply sources, and the third tank 12*c* is the supply destination. The opening/closing valves 13*a*1, 13*b*1, and 13*c*2 are opened, and the other opening/closing valves 13*a*2, 13*b*2, and 13*c*1 are closed. FIG. 14 illustrates the open/closed states of the opening/closing valves when the second tank 12*b* is the supply source, and the third tank 12*c* is the supply destination. The opening/closing valves 13*b*1 and 13*c*2 are opened, and the other opening/closing valves 13*a*1, 13*a*2, 13*b*2, and 13*c*1 are closed.

FIG. 15 illustrates the open/closed states of the opening/closing valves when the second tank 12*b* is the supply source, and the first tank 12*a* and the third tank 12*c* are the supply destinations. The opening/closing valves 13*a*2, 13*b*1, and 13*c*2 are opened, and the other opening/closing valves 13*a*1, 13*b*2, and 13*c*1 are closed. As described above, the opening/closing valve control unit 15 controls the opening and closing of the opening/closing valves 13*a*1, 13*a*2, 13*b*1, 13*b*2, 13*c*1, and 13*c*2 in order to obtain the open/closed states as illustrated in FIG. 4 to FIG. 15.

Next, FIG. 16 to FIG. 23 illustrate a modified example in which a fourth tank 12*d* is added as the ink tank, and opening/closing valves 13*d*1 and 13*d*2 are added for the fourth tank 12*d*.

In other words, four of the ink tanks are provided.

Figure 16:
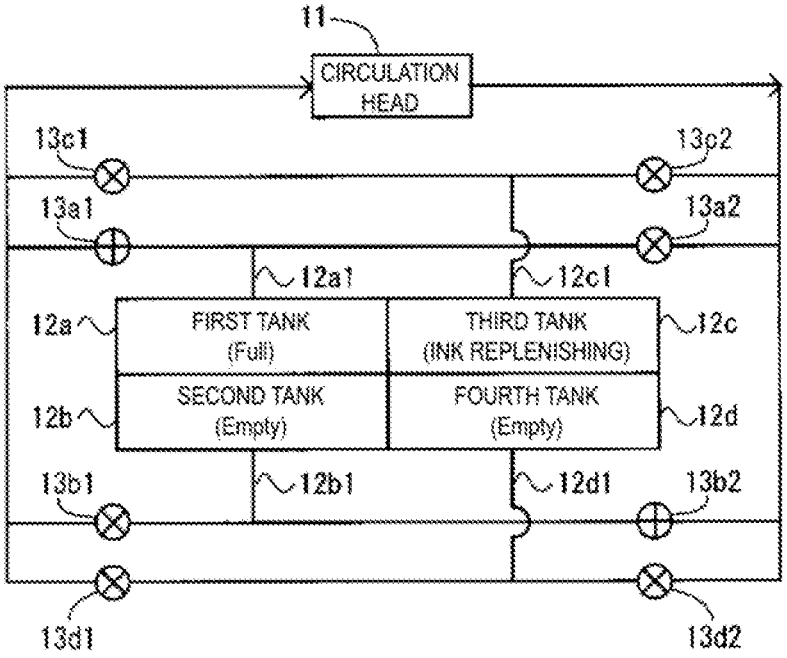
FIG. 16 is a schematic configuration diagram illustrating a state of a process of circulating the ink using four of the ink tanks.
Figure 17:
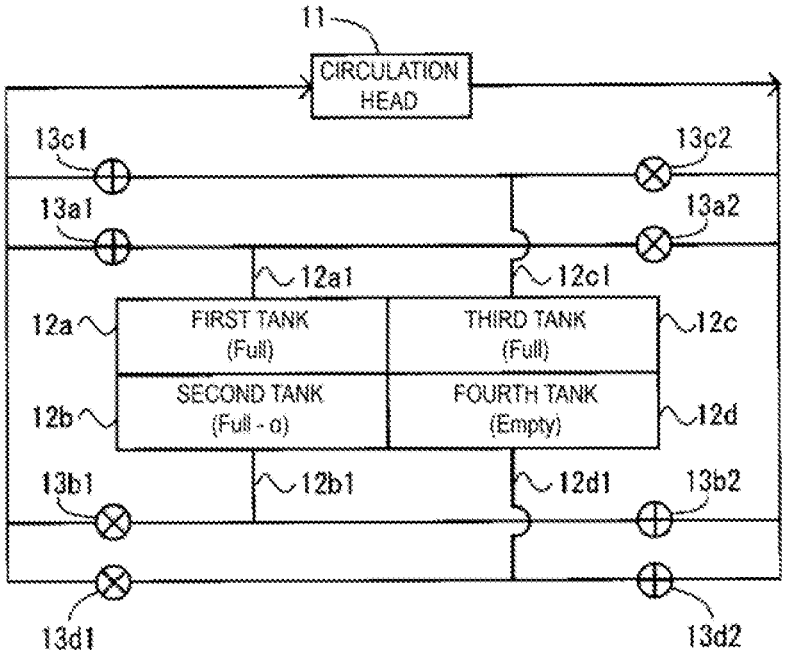
FIG. 17 is a schematic configuration diagram illustrating a state of the process of circulating the ink using the four ink tanks.
Figure 18:
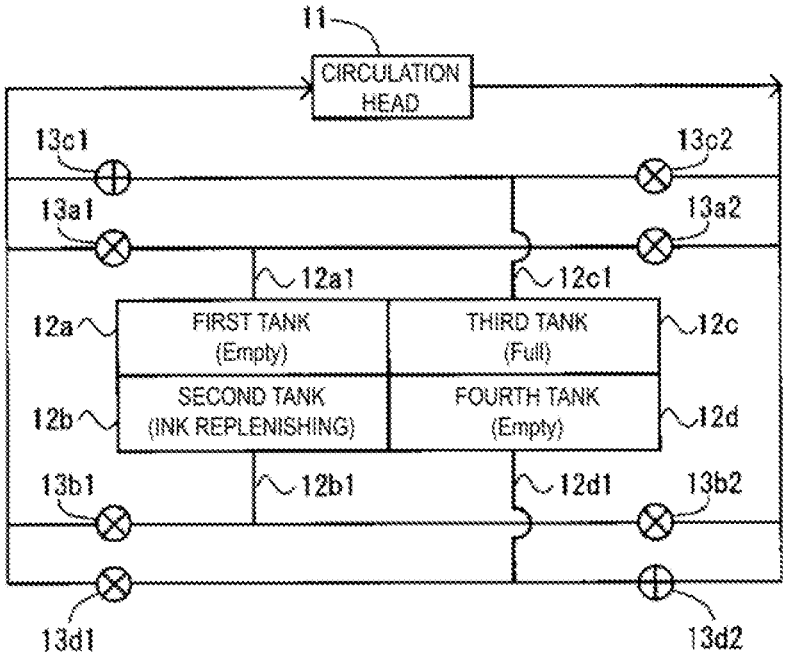
FIG. 18 is a schematic configuration diagram illustrating a state of the process of circulating the ink using the four ink tanks.
Figure 19:
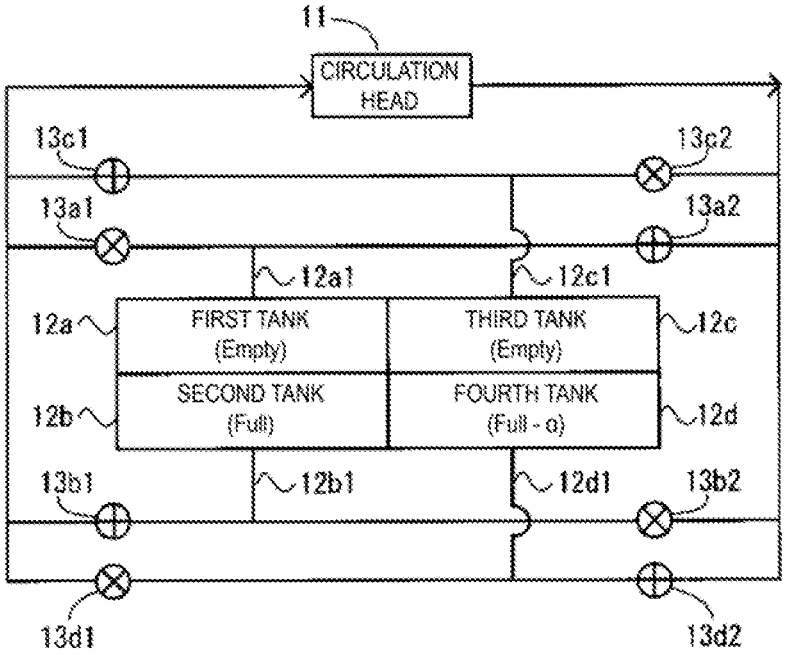
FIG. 19 is a schematic configuration diagram illustrating a state of the process of circulating the ink using the four ink tanks.
Figure 20:
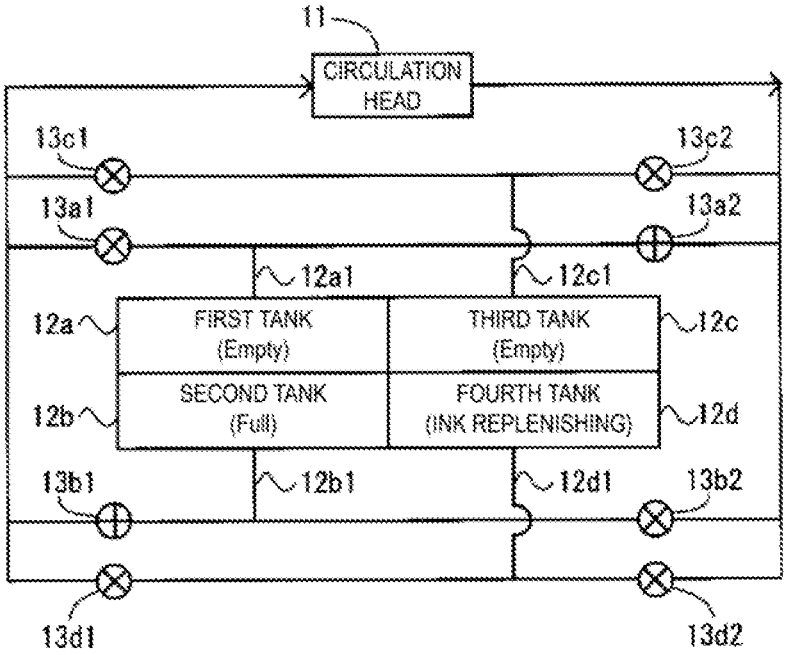
FIG. 20 is a schematic configuration diagram illustrating a state of the process of circulating the ink using the four ink tanks.
Figure 21:
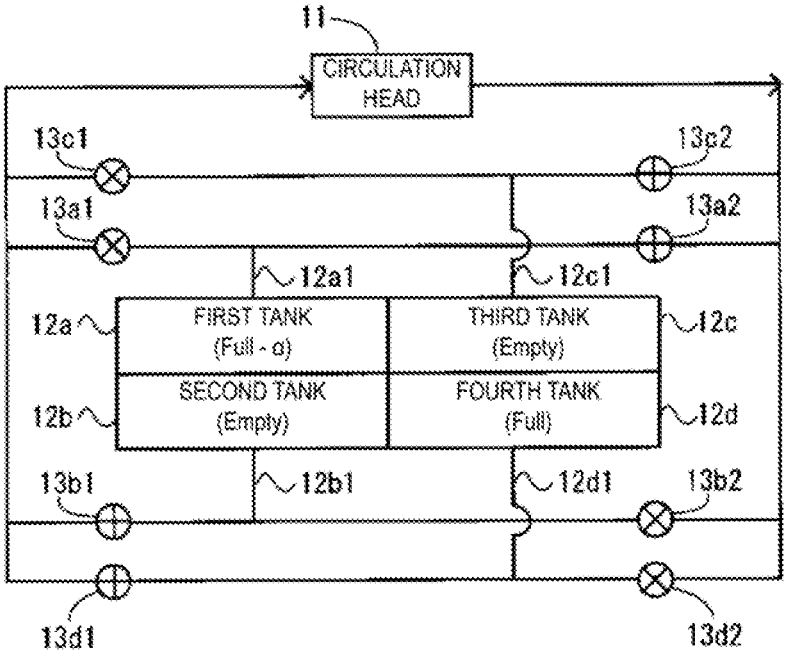
FIG. 21 is a schematic configuration diagram illustrating a state of the process of circulating the ink using the four ink tanks.
Figure 22:
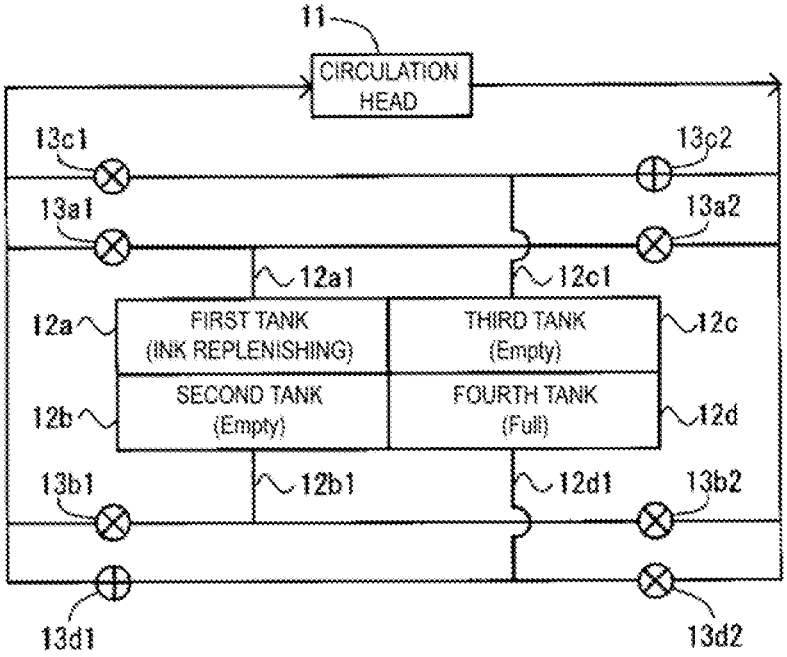
FIG. 22 is a schematic configuration diagram illustrating a state of the process of circulating the ink using the four ink tanks.
Figure 23:
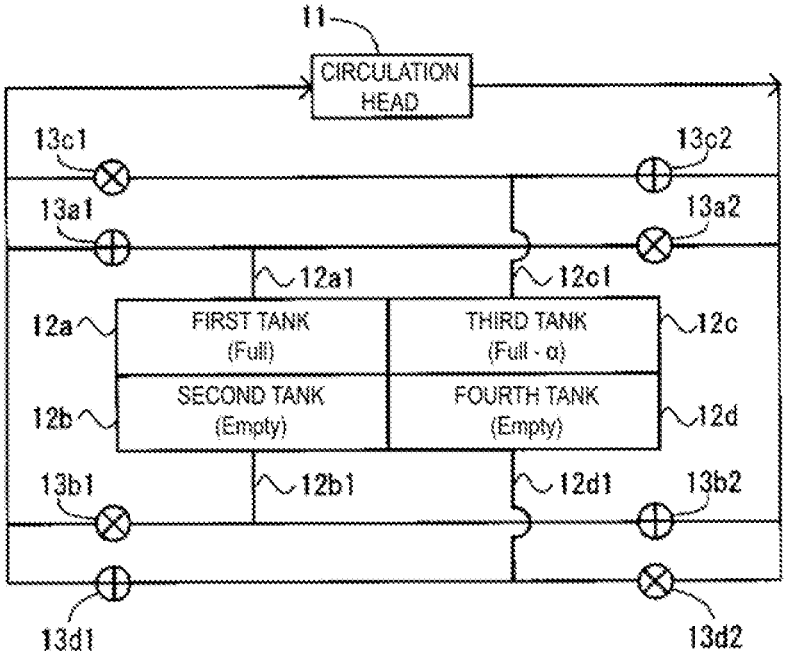
FIG. 23 is a schematic configuration diagram illustrating a state of the process of circulating the ink using the four ink tanks.

FIG. 16 is a state in which the first tank 12*a* is the supply source and the second tank 12*b* is the supply destination, and the state transitions, through a state illustrated in FIG. 17, to a state illustrated in FIG. 18 in which the third tank 12*c* is the supply source and the fourth tank 12*d* is the supply destination. Further, the state transitions, through a state illustrated in FIG. 19, to a state illustrated in FIG. 20 in which the second tank 12*b* is the supply source and the first tank 12*a* is the supply destination, then, through a state illustrated in FIG. 21, to a state illustrated in FIG. 22 in which the fourth tank 12*d* is the supply source and the third tank 12*c* is the supply destination, and through a state illustrated in FIG. 23, to the initial state illustrated in FIG. 16.

This control is different from the control illustrated in FIG. 4 to FIG. 15 in that when switching the supply source and the supply destination, control for adding an ink tank is performed for each of the supply source and the supply destination. Note that specific open/closed states of the opening/closing valves 13*a*1, 13*a*2, 13*b*1, 13*b*2, 13*c*1, 13*c*2, 13*d*1, and 13*d*2 are illustrated in the drawings. The opening/closing valve to be opened is indicated by a symbol+ in a circle, and the opening/closing valve to be closed is indicated by a symbol×in a circle.

In addition, when opening the opening/closing valve of one of the ink tanks, the opening/closing valve control unit 15 temporarily creates a state in which the opening/closing valve is simultaneously open to another one of the ink tanks, and when opening and closing each of the opening/closing valves, the opening/closing valve control unit 15 causes the time required to open the opening/closing valve to be longer than the time required to close the opening/closing valve.

In order to circulate the ink, in addition to the opening and closing control of the opening/closing valves 13*a*1, 13*a*2, 13*b*1, 13*b*2, 13*c*1, 13*c*2, 13*d*1, and 13*d*2 by the opening/ closing valve control unit 15, pressure regulation in each of the ink tanks (the first to fourth tanks 12*a* to 12*d*) by the pressure regulation control unit 14 is required.

Q={PA−PB}/RT, when a potential pressure at a surface position of the orifice plate 11*a* as viewed from the liquid surface of the ink tank serving as the supply source is PA, a potential pressure at the surface position of the orifice plate 11*a* as viewed from the liquid surface of the ink tank serving as the supply destination is PB, a total flow path resistance of an ink flow path network, which consists of an internal flow path resistance of each of the pipe conduits and the circulation head 11, is R, and a circulation flow rate is Q. (Note that, since the surface position of the orifice plate 11*a* is higher than the liquid surface of the ink tank serving as the supply source and the liquid surface of the ink tank serving as the supply destination, PA and PB are negative values). Here, the potential pressure at the liquid surface of the ink tank serving as the supply destination as viewed from the surface position of the orifice plate 11*a* can be considered to be a downstream pressure source, and the potential pressure at the liquid surface of the ink tank serving as the supply source as viewed from the surface position of the orifice plate 11*a* can be considered to be an upstream pressure source.

While causing the total flow path resistance R to be a fixed value and maintaining a predetermined negative meniscus pressure at the nozzle 11*a*1 in the orifice plate 11*a*, the pressure regulation control unit 14 regulates the pressures via the pressure regulating pipes 12*a*3 to 12*d*3 by generating the potential pressure PA at the surface position of the orifice plate 11*a* as viewed from the ink tank serving as the supply source and by generating the potential pressure PB at the surface position of the orifice plate 11*a* as viewed from the ink tank serving the supply destination, in order to obtain a predetermined circulation flow rate Q.

In this way, the pressure regulation control unit 14 adjusts the pressure in each of the ink tanks (the first to fourth tanks 12*a* to 12*d*) so as to cause one of the ink tanks (the first to fourth tank 12*a* to 12*d*) to be the ink tank serving as the supply source and cause one of the ink tanks (the first to fourth tanks 12*a* to 12*d*) to be the ink tank serving as the supply destination, and the opening/closing valve control unit 15 controls the opening and closing of each of the opening/closing valves 13*a*1, 13*a*2, 13*b*1, 13*b*2, 13*c*1, 13*c*2, 13*d*1, and 13*d*2 so that the ink is supplied from the ink tank serving as the supply source to the circulation head 11, and the ink is supplied from the circulation head 11 to the ink tank serving as the supply destination. In addition, the pressure regulation control unit 14 generates the appropriate potential pressures PA and PB while referring to the detection results of the air pressure sensors 12*a*5 to 12*c*5 and the water pressure sensors 12*a*6 to 12*c*6 of the ink tank serving as the supply source and to the detection results of the air pressure sensors 12*a*5 to 12*c*5 and the water pressure sensors 12*a*6 to 12*c*6 of the ink tank serving as the supply destination.

Figure 24A:
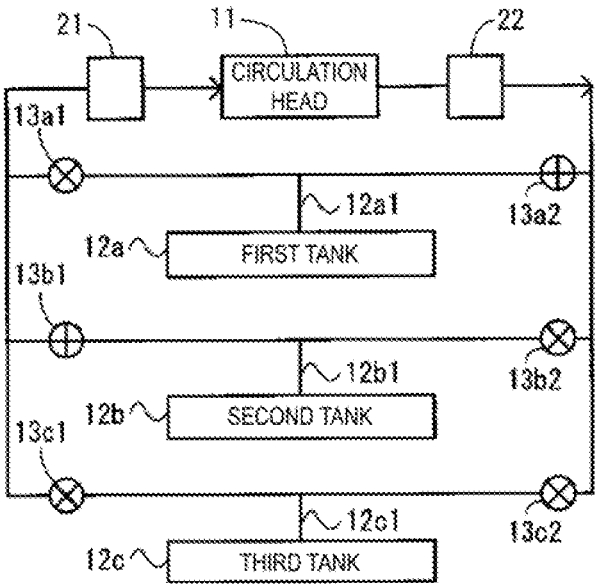
FIGS. 24A and 24B illustrate the inkjet recording device according to a modified example.
Figure 24B:
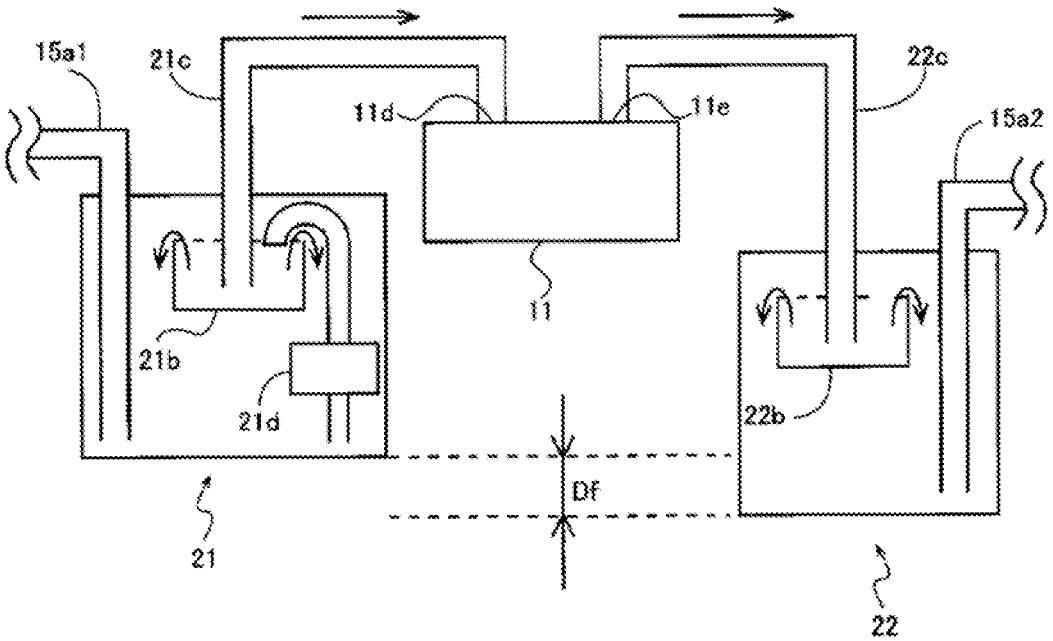

FIGS. 24A and 24B illustrates schematic configuration diagram of main portions of the inkjet recording device according to a modified example. FIG. 24A illustrates an entire ink supply path, and FIG. 24B illustrates the ink supply path near the circulation head.

In this modified example, the ink is caused to flow, via the circulation head 11, from a supply source intermediate tank 21 added to the pipe conduit 15*a*1 of the example illustrated in FIG. 1 to FIG. 15, to a supply destination intermediate tank 22 added to the pipe conduit 15*a*2. The supply source intermediate tank 21 is disposed, in the pipe conduit 15*a*1, at a position downstream of a position at which all the pipe conduits from the opening/closing valves 13*a*1, 13*b*1, and 13*c*1 converge, and upstream of the upstream port 11*d* of the circulation head 11.

The supply destination intermediate tank 22 is disposed, in the pipe conduit 15*a*2, at a position upstream of a position at which the pipe conduit branches into the opening/closing valves 13*a*2, 13*b*2, and 13*c*2, and downstream of the downstream port lie of the circulation head 11. In upper parts of the interior of the supply source intermediate tank 21 and the supply destination intermediate tank 22, dish-shaped ink storage units 21*b* and 22*b* that are open upward are provided, respectively, and the ink inlet/outlet ports 21*c* and 22*c* are open at positions below the upper ends of the ink storage units 21*b* and 22*b*. In addition, a pumping mechanism 21*d* is provided that pumps the ink into the ink storage unit 21*b* in the supply source intermediate tank 21. The ink inlet/outlet ports 21*c* and 22*c* configure a portion of the pipe conduits 15*a*1 and 15*a*2, respectively.

Here, the supply source intermediate tank 21 and the supply destination intermediate tank 22 are formed in substantially the same shape except that the supply destination intermediate tank 22 is not provided with the pumping mechanism for pumping the ink, and, in terms of an installation position, the supply source intermediate tank 21 is arranged at a position higher than the supply destination intermediate tank 22 by a distance Df. In theory, the difference in the potential pressures is affected not only by the difference in the arrangement heights of the supply source intermediate tank 21 and the supply destination intermediate tank 22, but also by the difference in the liquid surfaces. Thus, the circulation flow rate Q of the ink changes due to changes in the liquid surfaces caused by the transfer of the ink.

However, in this modified example, the dish-shaped ink storage units 21*b* and 22*b* that are open upward are provided in the interior of the intermediate tanks, and the difference in the liquid surfaces of the ink storage units 21*b* and 22*b* corresponds to the difference in the potential pressures. In the supply destination intermediate tank 22, the transferred ink overflows over the upper edge of the ink storage unit 22*b*, and the liquid surface of the ink storage unit 22*b* is thus kept constant. Further, in the supply source intermediate tank 21 also, since the ink is being supplied from the ink tank serving as the supply source to the supply source intermediate tank 21 at an amount greater than the amount of ink transferred to the circulation head 11 via the ink inlet/outlet port 21*c*, and further, since the pumping mechanism 21*d* constantly pumps the ink stored at the bottom of the ink tank at an amount greater than the amount of ink transferred to the circulation head 11 via the ink inlet 21*c*, the ink overflows over the upper edge of the ink storage unit 21*b*, so the liquid surface of the ink storage unit 21*b* is kept constant.

As a result, at all times, only the difference Df in the arrangement positions of the ink storage units 21*b* and 22*b* affects the difference in the potential pressures, thus making the difference in the potential pressures constant. When the difference in the potential pressures is constant, the total flow path resistance R is constant, thus making the circulation flow rate Q constant. Note that in the supply source intermediate tank 21, the pumping mechanism 21*d* need not necessarily be provided, and one end of the pipe conduit 15*a*1 may be disposed inside the ink storage unit 21*b*. In this case, a flow path for collecting the ink that has overflowed from the ink storage unit 21*b* is separately provided in the supply source intermediate tank 21.

In this way, the supply source intermediate tank 21 is provided between the ink tank and the upstream port 11*d*, and the supply destination intermediate tank 22 is provided between the ink tank and the downstream port 11*e*. The supply source intermediate tank 21 and the supply destination intermediate tank 22 respectively include the intermediate ink inlet/outlet ports 21*c* and 22*c* that are respectively in communication with the upstream port 11*d* and the downstream port 11*e*, and the dish-shaped ink storage units 21*b* and 22*b* that are open upward and provided in the upper parts of the interior thereof. The intermediate ink inlet/outlet ports 21*c* and 22*c* are open at the positions below the upper ends of the ink storage units 21*b* and 22*b*. The pumping mechanism 21*d* is provided that pumps the ink into the ink storage unit 21*c* in the supply source intermediate tank 21, and the upper end of the ink storage unit 21*b* in the supply source intermediate tank 21 is arranged to be higher than the upper end of the ink storage unit 22*b* in the supply source intermediate tank 22 by a predetermined height (Df).

Figure 25:
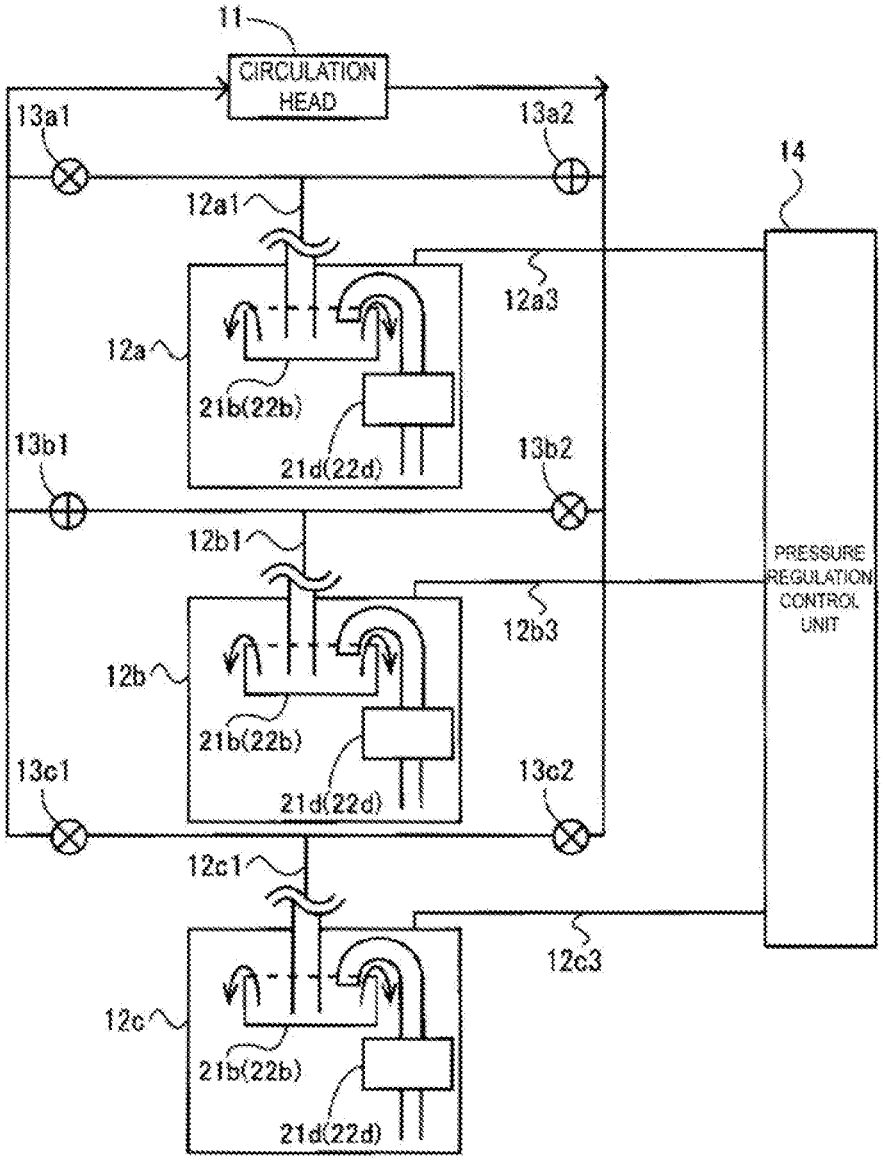
FIG. 25 is a schematic configuration diagram of main portions of the inkjet recording device according to a modified example.

FIG. 25 illustrates a schematic configuration diagram of main portions of the inkjet recording device according to a modified example.

In this modified example, the structure of the supply source intermediate tank 21 illustrated in FIGS. 24A and 24B is employed in the first tank 12*a* to the third tank 12*c* illustrated in FIG. 1 and FIG. 4 to FIG. 15.

In this modified example, although the arrangement heights of the first tank 12*a* to the third tank 12*c* are the same, the pressure regulation control unit 14 generates a difference in pressures (P1>P2) in order to generate a predetermined difference in the potential pressures. Although the height of the liquid surface of the ink storage unit 21*b* is the same in each of the first tank 12*a* to the third tank 12*c*, since the pressure regulation control 14 generates the predetermined difference in the potential pressures (P1>P2), the difference in the potential pressures becomes constant, thus making the total flow path resistance R and consequently the circulating flow rate Q constant.

According to this modified example, since the heights of the liquid surfaces of the first tank 12*a* to the third tank 12*c* are the same, a water head difference is not generated. Thus, the pressure regulation control unit 14 can be dedicated to generating the difference in pressures (P1>P2) based on only the total flow path resistance R and the circulation flow rate Q. As a result, pressure regulation control can be simplified, and consequently, a more uniform circulation flow rate Q can be expected.

Of course, the present disclosure can be applied even when the arrangement heights of the first tank 12*a* to the third tank 12*c* are required to be different. In this case, in theory, in addition to the arrangement heights, changes in the liquid surfaces based on the usage amount of the ink are added as a factor, but at least it is possible to prevent the liquid surfaces from changing based on the usage amount of the ink. Then, the only factor to be considered is the arrangement heights that are fixed values, so a uniform circulation flow rate Q can be expected.

Note that it goes without saying that the present disclosure is not limited to the above-described examples. Although the following is a matter of course for those skilled in the art, the following are each disclosed as an example of the present disclosure.

An application in which a combination of mutually replaceable members, configurations, and the like disclosed in the above-described examples is appropriately changed An application in which members, configurations and the like that are not disclosed in the above-described examples, but are known technologies and which are mutually replaceable with the members, configurations, and the like disclosed in the above-described examples, are appropriately substituted or a combination thereof is changed An application in which members, configurations and the like that are not disclosed in the above-described examples, but can be assumed to be substitutes for the members, configurations, and the like disclosed in the above-described examples based on known technologies and the like are appropriately substituted or a combination thereof is changed the following are each disclosed as an example of the present disclosure.

What is claimed is:

1. A liquid ejection device that includes a circulation head including an upstream port and a downstream port that are in communication with a pressure chamber and a plurality of ink tanks, and that causes ink to pass through the circulation head via the upstream port and the downstream port to cause the ink to flow from one of the ink tanks to another one of the ink tanks, the liquid ejection device comprising:

at least three of the ink tanks, each of the ink tanks including an ink inlet/outlet port in communication with the upstream port and the downstream port, an opening/closing valve that independently opens and closes the ink inlet/outlet port of each of the ink tanks to the upstream port and the downstream port, a pressure regulation control unit configured to regulate, for each of the ink tanks, a pressure in each of the ink tanks; and an opening/closing valve control unit configured to control, for each of the ink tanks, opening and closing of each of the opening/closing valves, wherein the pressure regulation control unit controls the pressure in each of the ink tanks so as to cause one of the ink tanks to be an ink tank serving as a supply source and another one of the ink tanks to be an ink tank serving as a supply destination, and the opening/closing valve control unit controls the opening and closing of each of the opening/closing valves so as to cause the ink to be supplied from the ink tank serving as the supply source to the circulation head and the ink to be supplied from the circulation head to the ink tank serving as the supply destination.

2. The liquid ejection device according to claim 1, wherein when opening the opening/closing valve of one of the ink tanks, the opening/closing valve control unit causes the opening/closing valve to go through a state of being open simultaneously to a plurality of the ink tanks.

3. The liquid ejection device according to claim 1, wherein when opening and closing each of the opening/closing valves, the opening/closing valve control unit causes a time required to open each opening/closing valve to be longer than a time required to close each opening/closing valve.

4. The liquid ejection device according to claim 1, wherein the number of the ink tanks is three.

5. The liquid ejection device according to claim 1, wherein the number of the ink tanks is four.

6. The liquid ejection device according to claim 1, wherein the ink tank includes, in an upper part of an interior thereof, a dish-shaped ink storage unit that is open upward, the ink inlet/outlet port is open at a position below an upper end of the ink storage unit, and a pumping mechanism is provided that pumps the ink into the ink storage unit in the ink tank.

7. The liquid ejection device according to claim 1, wherein a supply source intermediate tank is provided between the ink tank and the upstream port, a supply destination intermediate tank is provided between the ink tank and the downstream port, the supply source intermediate tank and the supply destination intermediate tank each include an intermediate ink inlet/outlet port that is in communication with the upstream port and the downstream port, a dish-shaped ink storage unit that is open upward is provided in an upper part of an interior of each of the supply source intermediate tank and the supply destination intermediate tank, the intermediate ink inlet/outlet port is open at a position below an upper end of the ink storage unit, a pumping mechanism is provided that pumps the ink into the ink storage unit in the supply source intermediate tank, and an upper end of the ink storage unit in the supply source intermediate tank is arranged to be higher than an upper end of the ink storage unit in the supply destination intermediate tank, by a predetermined height.

* * * * *